US007017910B1

(12) United States Patent
Armstrong

(10) Patent No.: US 7,017,910 B1
(45) Date of Patent: Mar. 28, 2006

(54) CARD GAME

(76) Inventor: Saundra Faye Armstrong, 7107 N. Broad St., Philadelphia, PA (US) 19126

( * ) Notice: Subject to any disclaimer, the term of this patent is extended or adjusted under 35 U.S.C. 154(b) by 0 days.

(21) Appl. No.: 10/948,477

(22) Filed: Sep. 23, 2004

(51) Int. Cl.
*A63F 1/00* (2006.01)

(52) U.S. Cl. ..... 273/292; 273/236; 273/243; 273/430

(58) Field of Classification Search ..... 273/292, 273/236, 243, 430
See application file for complete search history.

(56) References Cited

U.S. PATENT DOCUMENTS 4,014,547 A * 3/1977 Gomez et al. ..... 273/243
4,074,442 A * 2/1978 Landry ..... 434/129
4,236,719 A * 12/1980 Kerr ..... 273/265
4,302,016 A * 11/1981 Astle et al. ..... 273/278
4,378,941 A * 4/1983 Derby ..... 273/273
4,671,516 A * 6/1987 Lizzola et al. ..... 273/299
4,773,650 A * 9/1988 Doughty ..... 273/247
4,832,346 A * 5/1989 Pierce ..... 273/247
4,984,805 A * 1/1991 Medlock ..... 273/248
5,094,460 A * 3/1992 Morse et al. ..... 273/254
5,259,623 A * 11/1993 Kanelos, Sr. ..... 273/249
5,417,432 A * 5/1995 Dwyer ..... 273/299
5,433,449 A * 7/1995 Sowek ..... 273/248
5,529,308 A * 6/1996 Masakayan ..... 273/243
5,722,658 A * 3/1998 Talmage et al. ..... 273/243
5,813,819 A * 9/1998 Ohsawa et al. ..... 414/416.08
6,123,334 A * 9/2000 Norris ..... 273/251
6,145,838 A * 11/2000 White ..... 273/295
6,276,686 B1 * 8/2001 Chille ..... 273/243
6,428,404 B1 * 8/2002 Walker et al. ..... 451/311
6,450,499 B1 * 9/2002 Letang ..... 273/272
6,488,283 B1 * 12/2002 Grundy ..... 273/253
6,497,412 B1 * 12/2002 Bramm ..... 273/430
6,599,128 B1 * 7/2003 Roberts ..... 434/128
6,641,402 B1 * 11/2003 Boggs ..... 434/236
6,702,581 B1 * 3/2004 Walker ..... 434/167

* cited by examiner

*Primary Examiner*—Stephen Blau
*Assistant Examiner*—Dolores Collins
(74) *Attorney, Agent, or Firm*—Ethan D. Civan

(57) ABSTRACT

A game, including a plurality of Message Cards. In another aspect, a method of playing a card game, including providing a plurality of Message Cards to each player and each player in his or her turn providing one or more Message Cards from his or her hand to one or more other players.

8 Claims, 1 Drawing Sheet

CARD GAME

FIELD OF THE INVENTION

The present invention relates generally to card games. More particularly, it relates to card games that permit players to communicate with one another.

BACKGROUND

The lack of adequate communication between family members and friends is a constant problem in social interaction. This can be caused by the lack of time in which to communicate regularly due to busy schedules, the hesitancy of individuals to raise sensitive topics, or other reasons. A game that encourages individuals to communicate about topics that are important to them can therefore serve an important purpose in addition to its strictly recreational role.

SUMMARY OF THE INVENTION

A game, including a plurality of Message Cards. In another aspect, a method of playing a card game, including providing a plurality of Message Cards to each player and each player in his or her turn providing one or more Message Cards from his or her hand to one or more other players.

DETAILED DESCRIPTION OF THE PREFERRED EMBODIMENTS

Figure 1:
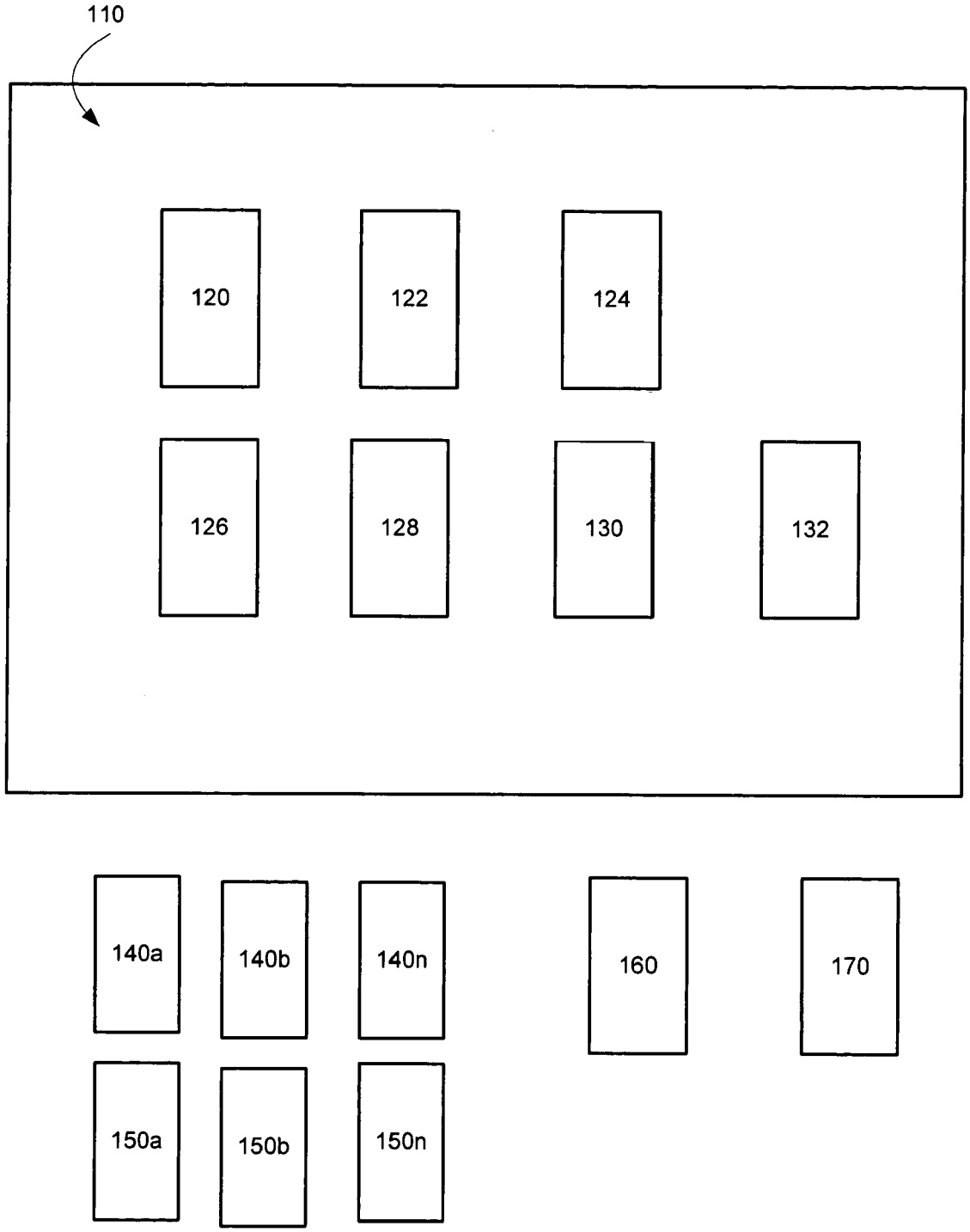
FIG. 1 is an illustration of a first embodiment of the present invention.

The following definitions are provided to aid in construing the claims of the present application:

Message Card: A playing card that either contains a message to be communicated to a player of the card game or a playing card that is blank and on which a player can write a message to be communicated to a player of the card game.

Progress Card: A playing card that is not a Message Card and that is used in playing the card game.

Referring to FIG. 1, a first preferred embodiment of a card game in accordance with the present invention is illustrated. A board 110, includes five deck locations, 120, 122, 124, 126, 128, and 128, on which Message Cards are initially placed. Board 110 also includes Deck locations 130 and 132 where Progress Cards are initially placed. In the first embodiment, the board further includes ten stars representing the ten commandments, as well as the commercial name of the card game. In other embodiments of the present invention, a different number of deck locations (or even none at all) can be used, and additional or different board features can be used. In some embodiments of the present invention, no board is used.

Message Cards 140*a* though 140*n* include between fifty-two (52) and eighty (80) Message Cards separated into five decks in the first preferred embodiment; however, in other embodiments of the present invention, any number of Message Cards can be utilized and any number of decks (even only one) can be used. Each of the five decks has a different category of card in the first preferred embodiment, one deck relating to "I need", one to "I promise", one to "I feel", one to "Thank you", and one to "Forgive me". However, in other embodiments of the present invention, different categories can be utilized, or the cards need not be broken down by category.

The individual Message Cards can relate to children's issues, family issues, religious issues, sexual issues, political issues, or any other type of issues that are relevant. In some embodiments of the present invention, the Message Cards can be of mixed types so that the cards are relevant to different types of players. In other embodiments, the Message Cards can be uniform in nature so that the game is appropriate for a particular audience, such as children. In the first preferred embodiment, blank cards are also included so that players can write their own messages.

Examples of child oriented messages include "I promise I will take you to the park more often", "I feel that I am old enough to play outside by myself", "Thank you for taking me to the zoo and playground", "I need you to help me write my toy list to Santa this year", and "Forgive me for listening to you when you are on your phone I will stop that I know that you need your privacy". A few further examples are included in a list attached hereto as Appendix A. In other embodiments, other messages can be used covering virtually any subject of importance to the players of the game.

Progress Cards 150*a* through 150*n* are also illustrated in FIG. 1, as is finish envelope 160. In the first preferred embodiment, Progress Cards 150*a* through 150*n* include both start cards and finish cards; however, in other embodiments of the present invention, separate start and finish cards are not used, and in some embodiments of the present invention no Progress Cards are used. A finish envelope is also not used in all embodiments of the present invention.

Out envelope 170 is used to hold discarded cards in the first preferred embodiment. While this envelope is not utilized in all embodiments of the present invention, it, or a functional equivalent does play a useful role of providing a degree of confidentiality in certain circumstances; hence it provides a useful function, as described below.

In a first preferred embodiment of the present invention, the card game is played as followed. Each category of Message Cards is shuffled and placed on its corresponding deck location. The finish cards are shuffled and one is placed in the finish envelope. The start cards are shuffled and placed on their deck location.

Each of the one or more players playing the game then, in turn, receives his or her Message Cards as follows. The first player receives six cards from the first deck of Message Cards, selects two of these Message Cards and replaces the remaining four Message Cards. The player chooses these Message Cards based on the messages that he or she would like to communicate to the other player or players (or to himself or herself if playing alone). Play then continues to the other players until all players have two cards from the first deck. The same procedure is then followed with respect to the other four decks, so that each player is left with ten cards, two from each deck. Each player can then exchange any four Message Cards for any combination of four new Message Cards (picked from any deck) or blank cards with messages written in by the player.

The players then in turn give Message Cards to other players. On the first turn, a player can give two Message Cards to any one or more players. On the second turn, a player can give three Message Cards to any one or more players. On the third turn, a player can give any number of Message Cards to any one or more players. Each card that is played is shown only to the player to whom it is given and then is placed in the out envelope. The only exception is that if a Message Card is labeled as a whisper card, the player whispers its contents to the player to whom it is given and then the whisper card is replaced in the deck from which it was taken.

When a player has no cards left, he or she may draw one start card and compare it to the finish card in the finish envelope. If the two cards match, that player is the winner; otherwise, play passes to the next player and the players continue to take turns until one player (who has distributed all of his or her Message Cards) has a match.

If a player decides not to finish a game before distributing all of his or her Message Cards, the remaining Message Cards are placed in the out envelope without being shown to anyone. It is not intended that anyone should inspect the contents of the out envelope at any time prior to shuffling such cards back into the respective decks of Message Cards.

In other embodiments of the present invention, different rules can be used. For example, players can have a greater or lesser degree of choice over the Message Cards that they receive, Progress Cards need not be utilized, different numbers of cards can be played each turn, or the game can be played without turns (such as in real time), and the game can involve additional elements. In all embodiments, however, Message Cards are utilized.

The present invention may be embodied in other specific forms without departing from the spirit or essential attributes of the invention. Accordingly, reference should be made to the appended claims, rather than the foregoing specification, as indicating the scope of the invention.

What is claimed is:

1. A method of playing a card game, comprising the steps of:

(a) providing a plurality of Message Cards to each player;

(b) each player in his or her turn providing one or more Message Cards from his or her hand to one or more other players (c) dealing one or more Progress Cards to each player; and (d) terminating the game based on the value of a player's one or more Progress Cards.

2. The method of claim 1, wherein the value necessary to terminate the game is based on the value of another Progress Card.

3. The method of claim 1, wherein the game cannot terminate until the player has no more than a predetermined number of Message Cards remaining.

4. The method of claim 1, wherein at least one Message Card relates to a desire that a potential player of the game wishes to communicate to another player.

5. The method of claim 1, wherein at least one Message Card relates to a need that a potential player of the game wishes to communicate to another player.

6. The method of claim 1, wherein at least one Message Card relates to a fear that a potential player of the game wishes to communicate to another player.

7. The method of claim 1, wherein at least one Message Card relates to a problem that a potential player of the game wishes to communicate to another player.

8. The method of claim 1, wherein at least one Message Card is a blank card that a potential player of the game can complete to communicate any message to another player.

* * * * *